United States Patent [19]

Zoor

[11] Patent Number: 4,632,419

[45] Date of Patent: Dec. 30, 1986

[54] SKI BINDING

[75] Inventor: Reinhold Zoor, Munich, Fed. Rep. of Germany

[73] Assignee: Heinrich Wunder GmbH & Co. KG., Dachau, Fed. Rep. of Germany

[21] Appl. No.: 704,617

[22] Filed: Feb. 22, 1985

[30] Foreign Application Priority Data

Feb. 22, 1984 [DE] Fed. Rep. of Germany ..... 3406430
Oct. 15, 1984 [DE] Fed. Rep. of Germany ..... 3437725

[51] Int. Cl.[4] ..... A63C 9/10
[52] U.S. Cl. ..... 280/614
[58] Field of Search ..... 280/614, 615, 626, 631

[56] References Cited

U.S. PATENT DOCUMENTS

| | | | |
|---|---|---|---|
| 3,003,777 | 10/1961 | Hilding | 280/614 |
| 4,113,277 | 9/1978 | Zoor | 280/626 |
| 4,134,603 | 1/1979 | Zoor | 280/614 |
| 4,468,048 | 8/1984 | Wittmann et al. | 280/614 |

FOREIGN PATENT DOCUMENTS

| | | | |
|---|---|---|---|
| 400538 | 8/1924 | Fed. Rep. of Germany . | |
| 532953 | 9/1931 | Fed. Rep. of Germany . | |
| 569828 | 8/1933 | Fed. Rep. of Germany . | |
| 2307427 | 12/1973 | Fed. Rep. of Germany | 280/614 |

*Primary Examiner*—John J. Love
*Assistant Examiner*—Michael Mar
*Attorney, Agent, or Firm*—Peter K. Kontler

[57] ABSTRACT

The ski binding comprises a toe iron 1 and a rear soleholding device 2. The toe iron is shiftable between a position for ski touring and a position for downhill skiing. A U-shaped bearing bracket 7 and a plug-in pivot 12 are provided. By the two legs 8 and 9 of the bearing bracket the pivot is spaced from the ski a distance which somewhat exceeds the thickness of the sole of the boot. As a result, the plug-in pivot 12 can be used as a holding-down member and as an abutment. The edge portion of the sole is adapted to extend under the plug-in pivot and to be forced against the plug-in pivot 12 by the rear soleholding device. The rear soleholding device comprises a holding-down member 3 for effecting a release in a vertical direction and also comprises a slide 5 for effecting a release in a lateral direction under an overload. In that position the ski binding is used as a downhill binding. Alternatively, the sole of the boot can be connected to the bearing bracket 7 by the plug-in pivot 12 if the latter extends through a bearing bushing 20 provided in the sole 17 of the boot and is held by the legs 8 and 9 at the same time. In that case the boot is pivotable on the plug-in pivot. In such touring position of the ski binding the rear soleholding device is inactive.

19 Claims, 9 Drawing Figures

SKI BINDING

This invention relates to a ski binding for ski touring or cross country and downhill skiing.

Ski bindings of such type have been known for a long time (German Patent Specifications 400,538; 532,953, 569,828) and can be used as cross-country or touring bindings. The binding disclosed in German Patent Specification 400,538 was suitable also for downhill skiing because the previous skiing technique permitted downhill skiing also when the heel was not held down on the ski.

A basic disadvantage of more modern ski bindings for touring and downhill skis is that such bindings comprise a touring plate or touring frame, which must follow the pivotal movement of the boot when the skier is walking. This involves an additional effort, which is undesirable during long walks or on very difficult terrain.

It is an object of the invention to improve a ski binding of the kind described in such a way that the binding is extremely light in weight and is suitable for ski touring and downhill skiing and does not obstruct by an additional weight the movements of the boot which are required during ski touring.

In a ski binding for ski touring and downhill skiing, such object is accomplished in accordance with the invention by the provision of a shiftable toe iron or sole holding device, which in the touring position is in positive or frictional engagement with the toe portion of the skiing boot and can be shifted to constitute a soleholder of a downhill ski binding.

In the downhill position the toe iron constitutes a soleholder such as is usual in downhill bindings. Together with an additional heelholding device that toe iron moved to a downhill position constitutes a safety binding. If the toe iron is designed for a safety release, the heel-holding device must ensure that the boot will be released for a movement in a vertical direction. An additional release for a lateral movement must be permitted by the heel-holding device if the toe iron cannot effect a safety release in downhill position.

The very large saving in weight, which is important particularly during ski touring, is mainly due to the fact that the touring frame which is required in modern bindings for ski touring in order to permit a pivotal movement of the boot is eliminated because the toe portion of the boot will be positively held by the binding in touring position. Even if the boot is not pivotally movable in the toe iron, such positive engagement will permit of a walking with boots having flexible soles.

To permit a touring walk also with boots having stiff soles, the toe iron and the boot are provided with interengageable bearing elements, which hold the boot so that it can pivot about a fixed axis. Such positive and pivotal mounting of the toe portion of the boot will permit a touring walk with any boot, even if it has a rigid sole. The pivotal mounting of the skiing boot will not involve an additional weight loading because the bearing elements provided on the booth for such pivot movement are close to the pivotal axis and are extremely light in weight as they consist only of pivot pins or pivot bushings attached to the boot so that they do not involve an additional weight loading which would render a touring walk more difficult.

To permit the use of a simple structure for the positive engagement between the toe iron and the boot, a further feature of the invention resides in that the bearing elements provided on the toe iron are adapted to receive the associated mating elements provided on the boot in an open or receiving or releasing position and can be locked in the latter position by locking means so that the boot cannot become inadvertently separated from the toe iron.

To permit a release of the ski from the boot in case of a danger during ski touring, the toe iron may be secured to the ski by means of a disengageable mounting. This will permit an arbitrary release of the toe iron so that the skiing boot and the entire toe iron will be released from the ski.

If a safety feature is desired which will prevent an injury to the skier when he falls during ski touring, the toe iron may be secured to the ski by means of a safety mounting which is adapted to effect a release. Such mounting is described, e.g., in U.S. Pat. No. 4,134,603.

As has been generally explained hereinbefore, modern Alpine downhill technique requires for downhill skiing a heelholding device which when combined with a rigid toe iron must be adapted to release the boot for movements in vertical and lateral directions. A release for a movement only in a vertical direction will be sufficient if the toe iron is held by means of a safety mounting which can effect a release so that the toe portion of the boot can be laterally released. A heelholding device for effecting a release only in a vertical direction is described, e.g., in U.S. Pat. No. 4,113,277. A heelholding device for effecting a release in a vertical direction and in a lateral direction is described, e.g., in U.S. Pat. No. 4,134,603.

The invention is illustrated by way of example in the drawing, in which

Figure 1:
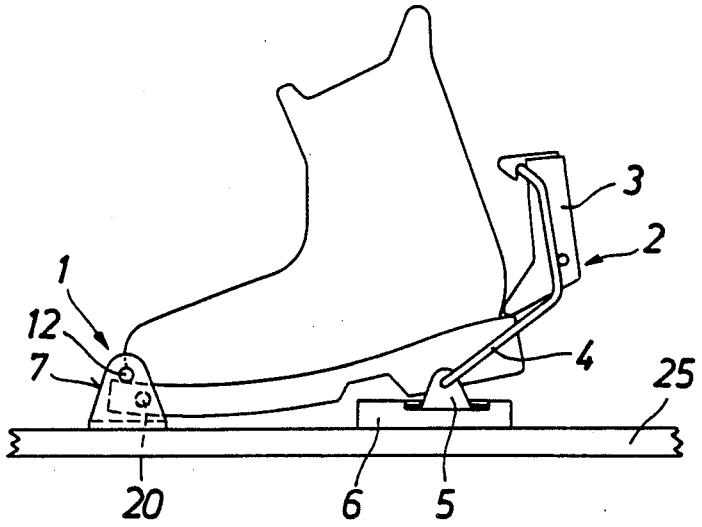
FIG. 1 is a side elevational view showing a ski binding in downhill position and a boot.
Figure 2:
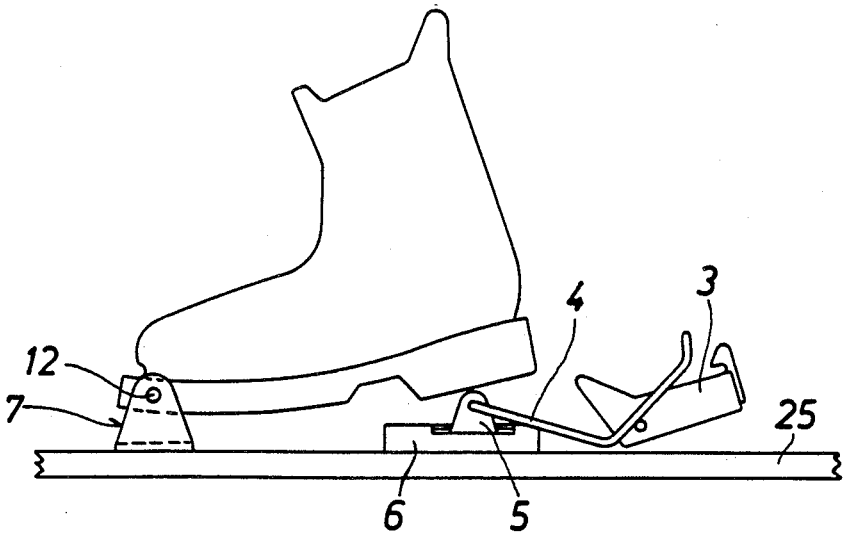
FIG. 2 shows the binding of FIG. 1 in touring position.

FIGS. 1 and 2 show a ski binding which can be used for ski touring and for downhill skiing. The ski binding comprises a toe iron 1 and a rear sole-holding device 2. The rear soleholding device 2 constitutes a heelholding device and comprises a holding-down member 3 which is released for a vertical movement under an overload and is pivotably connected by means of a U-shaped member 4 to a slide 5, which is mounted in a mounting 6 for a movement in a direction which is transverse to the longitudinal direction of the ski. The slide is held in position for use by a latching mechanism, not shown, which releases the slide 5 for a lateral movement under a predetermined overload.

Figure 3:
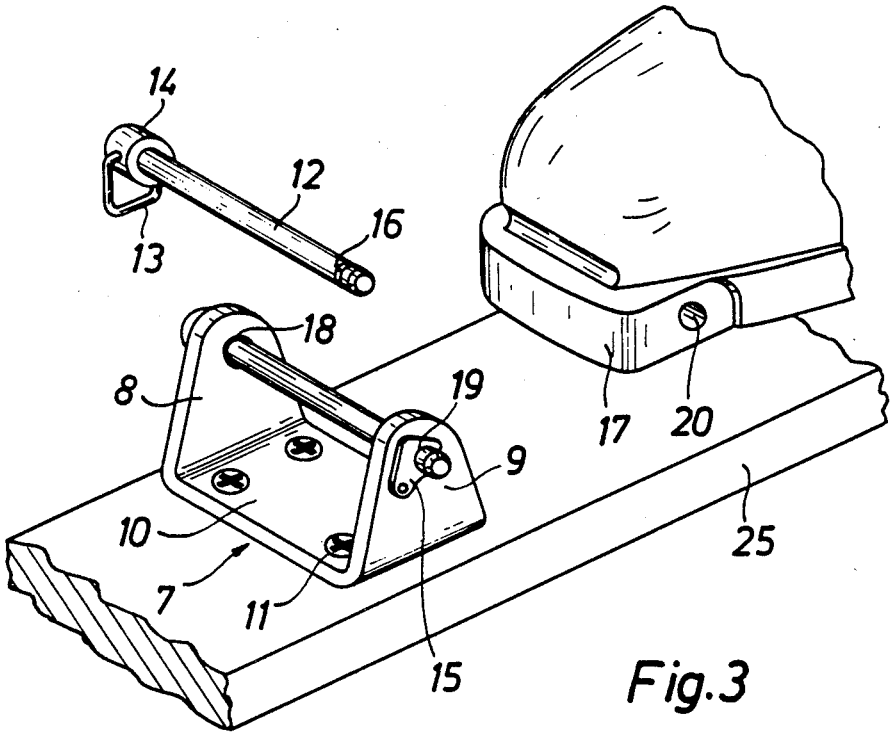
FIG. 3 is an elevational view showing the toe iron.

The design of the toe iron 1 is particularly clearly shown in FIG. 3. The toe iron comprises a U-shaped bearing bracket 7, which has two upright legs 8 and 9 and a base 10 for mounting the legs on the ski by means of screws 11. A plug-in pivot 12 is mounted in the legs 8 and 9 and is provided at one end with a small U-shaped handle 13, by means of which the plug-in pivot can be pulled out of its position for use. The handle 13 is pivoted to a head 14, which can be used to push the plug-in pivot to its position for use, in which said pivot is held by the two legs 8 and 9. A latch 15 enters a peripheral groove 16 of the plug-in pivot 12 to prevent the latter from falling out of its mounting.

Figure 5:
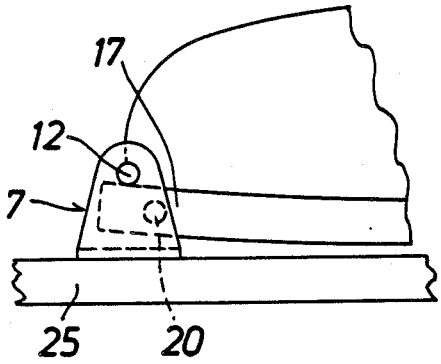
FIG. 5 is an elevational view showing the toe iron in downhill position and the toe portion of the boot.
Figure 6:
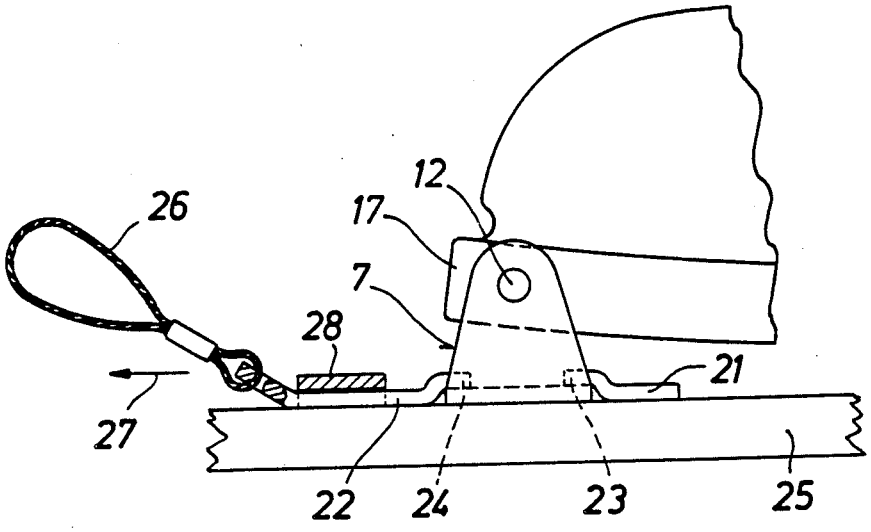
FIG. 6 shows a detachably mounted toe iron.

The toe iron 1 can assume two different positions for use and is shiftable between the two positions. The first position is illustrated in FIGS. 1 and 5. This is the downhill position, in which the foremost edge portion of the sole of the boot engages the plug-in pivot 12 from below while the pivot is held at a distance from the ski by the legs 8 and 9. Such distance is somewhat greater than the thickness of the sole. The plug-in pivot acts as a holding-down member for the sole and as an abutment for taking up the force which is exerted by the rear soleholding device 2. In the downhill position the holding-down member 3 applies pressure to the rearmost edge portion of the sole and thus holds down the boot and pushes it toward the plug-in pivot 12 so that the boot is held in position on the ski. In such position the skier is protected from injury in case of a forward fall and of a twisting fall because under a certain overload the holding-down member 3 will effect a release in a vertical direction and the slide 5 will effect a release in a lateral direction. As only the foremost edge portion of the sole of the boot extends under the plug-in pivot 12, the boot will be readily released in response to such a release operation when the binding is in the aforedescribed position.

Figure 4:
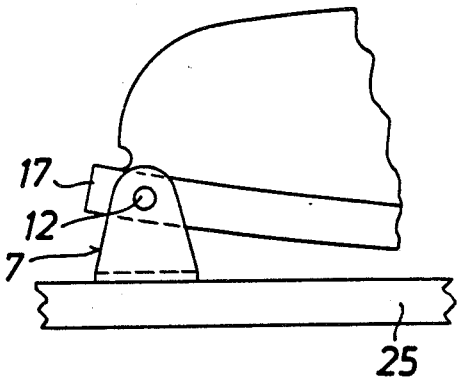
FIG. 4 is an elevational view showing the toe iron in touring position and the toe portion of the boot.

For ski touring the plug-in pivot 12 will not be inserted until the foremost end 17 of the sole of the boot extends between the legs 8 and 9 and the two bearing bores 18 and 19 of the legs 8 and 9 are aligned with a through bore of a bearing bushing 20 provided in the toe portion 17 of the boot. The bearing bushing 20 serves to receive the plug-in pivot 12, as is particularly apparent from FIGS. 2 and 4. A comparison between FIGS. 4 and 5 will reveal that the boot has been displaced further in the forward direction on the ski when the plug-in pivot 12 extends through the bearing bushing 20. As a result of such displacement, the boot no longer contacts the heelholding device 2 so that the latter can no longer obstruct the lifting of the boot from the ski, which is required during ski touring.

During a touring walk it may not only be desirable but in some cases absolutely necessary to effect a very quick release of the boot from the ski, e.g., in case of an avalanche. For this purpose the bearing bracket 7 is secured to the ski by two holders 21 and 22, of which the holder 21 is stationary and the holder 22 is slidably mounted. The two holders together constitute a mounting which can effect a release and has offset tongues 23 and 24, which engage the base 10 of the bearing bracket 7 to hold the latter on the ski 25. A loop 26 which is attached to the holder 22 can be pulled by hand to displace the holder 22 in the direction of the arrow 27. Such displacement is obstructed by a nut 28 so that a displacement can be effected only by a sufficiently strong pull.

Figure 7:
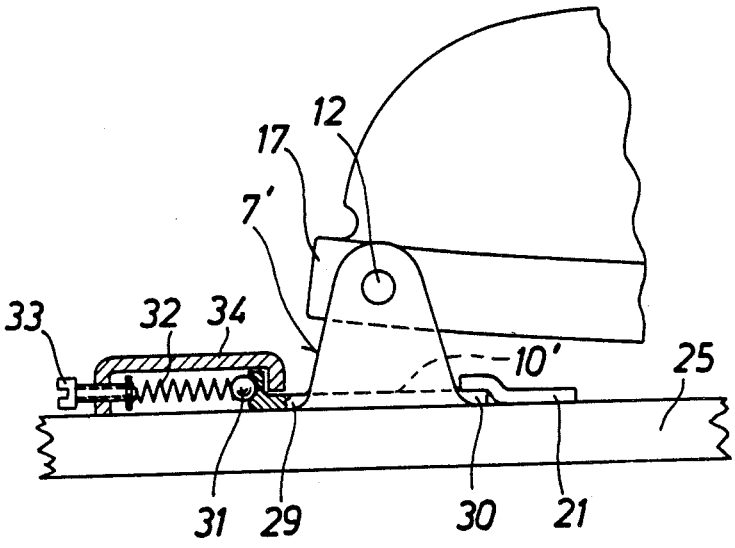
FIG. 7 shows the toe iron with a safety mounting for effecting a release.

In the embodiment shown in FIG. 7 the base 10' of the bearing bracket 7' has protruding edge portions 29 and 30. The edge portion 30 is held and guided by the holder 21. The edge portion 29 cooperates with a latching mechanism which comprises a latching ball 31, a latching spring 32 and an adjusting screw 33 in a housing 34. This arrangement constitutes a safety mounting which can effect a release because the latching ball 31 is forced by the latching spring 32 into a recess formed in the edge portion 29 and can leave the recess only under a predetermined load applied in a direction which is transverse to the longitudinal direction of the ski.

Figure 8:
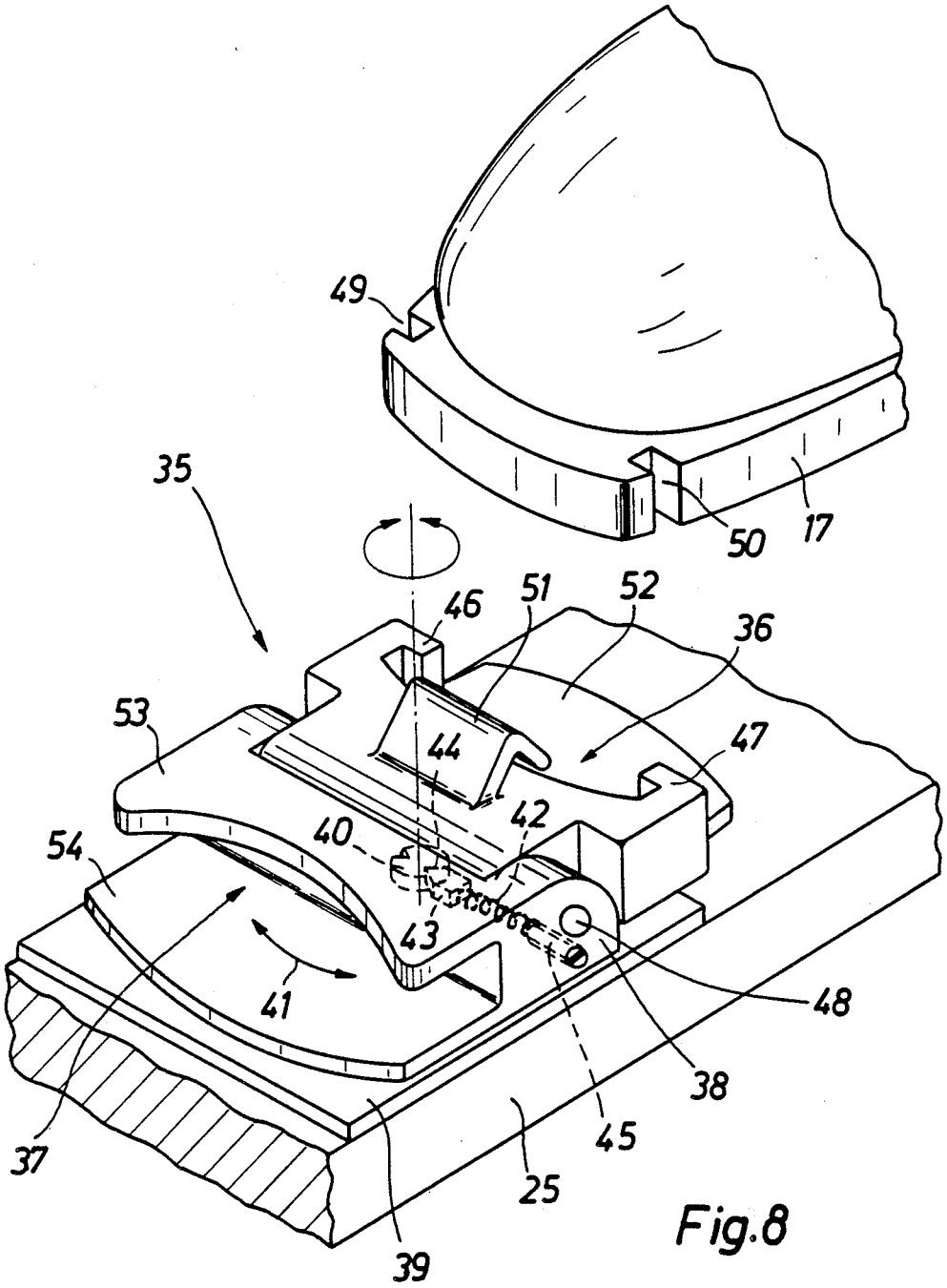
FIG. 8 shows another embodiment of the toe iron.

FIG. 8 shows the shiftable toe iron, which is 35 comprising two soleholders 36 and 37 which are directed toward each other. The soleholder 36 is intended for ski touring and the soleholder 37 for downhill skiing. Both soleholders and a common bearing bracket 38 are mounted on a common baseplate 39 which is rotatably mounted on the ski 25 by a pivot pin 40. By rotating in the directions indicated by the double-headed arrow 41, one of the soleholders or the other can be moved to a position for use in which the baseplate and the two soleholders are held by a latching mechanism which is provided in the bearing bracket 38 and comprises a latching spring 42 and a latching wedge 43 which is biased by the latching spring 42 and extends into a notch 44 of the pivot pin 40. The pressure applied by the latching spring 42 can be adjusted by an adjusting screw 45. The latching mechanism constitutes a safety mounting which can effect a release of the soleholder for a lateral pivotal movement when the applied torque is so high under a lateral loading of the boot that the skier might be injured.

The soleholder 36 comprises two tonglike jaws 46 and 47 and is pivotably mounted on a horizontal pivot 48 which is mounted in the bearing bracket 38. In position for use the jaws 46 and 47 extend into mating recesses 49 and 50 formed in the sole 17 of the boot. In order to ensure that the positive interengagement between the sole 17 of the boot and the jaws will be maintained, the soleholder 36 is provided with a retaining spring 51 which firmly forces the sole of the boot from above against a tread plate 52, which is fixed to the soleholder 36 and is contacted by the sole. Since the toe iron shown in FIG. 8 consists of plastic, the retaining spring 51 may be integrally molded with the soleholder 36.

The soleholder 37 for use in the downhill position comprises a holding-down member 53 which is carried by the bearing bracket 38 and extends with a clearance over the edge portion of the sole, and also comprises a tread plate 54 which is fixed to the bearing bracket 38. In the downhill position the sole 17 of the boot will rest on the tread plate 54 and the holding-down member 53 will extend with a small clearance over the sole 17. Both parts consisting of the holding-down member 53 and the tread plate 54 are integral with the bearing bracket 38 which accommodates the latching mechanism 42–45 and the pivot pin 40 which is secured to the ski.

Figure 9:
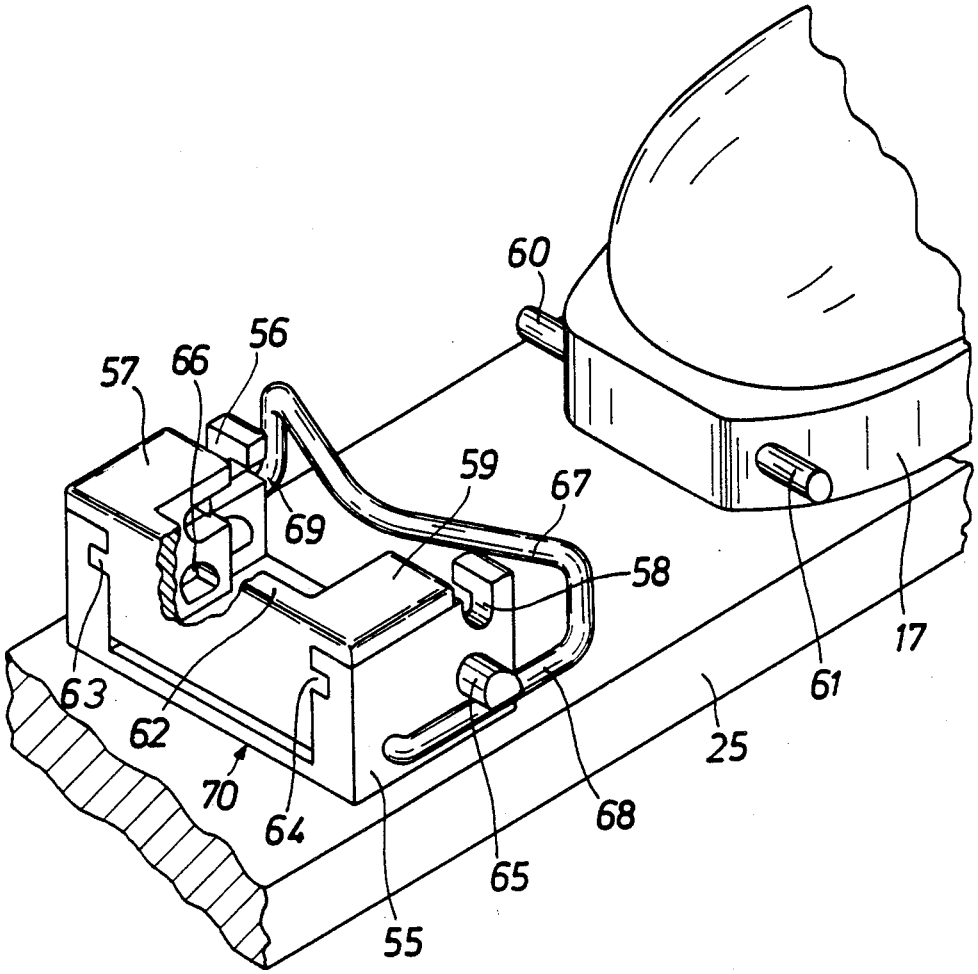
FIG. 9 shows a third embodiment of the toe iron.

Fig. 9 shows a further embodiment of a shiftable toe iron 70 for downhill skiing and ski touring. The this embodiment the toe iron comprises a bearing bracket 55 having two split bearings 56, 57 and 58, 59, which serve to receive pivot pins 60 and 61 which are provided on the sole 17 of the boot and protrude from the edge of the sole.

One embodiment 56 or 58 of each bearing is formed in the bearing bracket 55 and is open-topped. The other element 57 or 59 of each bearing is formed in a slider 62 which is slidably mounted on and guided by the bearing bracket 55 and is held on the bearing bracket 55 by dovetail guides 63 and 64 which permit a displacement of the slide 62 in a direction which is parallel to the surface of the ski. Two locking pins 65 are provided to lock the slider 62 in that position in which the bearings for the pivot pins 60 and 61 are closed. Only one of the pins 65 is visible. The pins 65 are mounted in the bearing bracket 55 of be slidable transversely to the longitudinal direction of the ski and are adapted to extend into mating bores 66 formed in the slider 62 to lock the latter in position for use in which the bearings 56, 57 and 58, 59 are closed.

The bearing bracket 55 is provided with a pivotable U-shaped toe-holding member 67 shown in FIG. 9 in a position for use in which the toe iron is in downhill position. In that position this sole 17 of the boot can be moved to under the U-shaped toe-holding member 67 and can be forced against that toe-holding member by a heel-holding device, not shown. In the downhill position an upward pivotal movement of the toe-holding member 67 is prevented in that the member 67 is locked by the locking means associated with the slider 62, i.e., by the slidable pins 65 which release the slider 62 when they protrude laterally from the bearing bracket 55 and extend over the legs 68 and 69 of the U-shaped toe-holding member 67. When the pins 65 extend into the bores 66, the pins 65 are flush with the outer surfaces of the bearing bracket 55 so that the toe-holding member 67 can then perform an upward pivotal movement away from the sole 17 of the boot. When the member 67 has been swung up, the pins 60 and 61 can be inserted into the split bearings 56, 57 and 58, 59 and can be held therein when the slider 62 has been displaced. In the resulting position the toe iron is suitable for ski touring.

I claim:

1. The combination of a ski boot having a sole with a toe portion and a heel portion and a ski binding for touring as well as cross country skiing, said binding comprising a toe iron directly affixed to the ski and having a single toe retaining means, said toe retaining means engaging a first part of the toe portion of the sole with the bottom of the toe portion of the sole being at a first level above the top surface of the ski so that the boot can pivot with reference to the toe iron about an axis extending substantially transversely of the ski during touring and cross country skiing, and said toe retaining means engaging a second part of the toe portion of the sole with the bottom of the toe portion of the sole being at a lower second level above the top surface of the ski during downhill skiing, said binding further comprising means for releasably holding the heel portion of the sole only when said toe retaining means is engaging said second part of the toe portion during downhill skiing, said holding means being affixed directly to the ski.

2. The combination of claim 1, wherein said toe retaining means and said toe respectively comprise cooperating first bearing elements and second bearing elements which are separable from each other so as to allow for conversion of the binding for downhill skiing.

3. The combination of claim 2, wherein said bearing elements define said pivot axis.

4. The combination of claim 2, further comprising a safety mounting for releasably securing the toe iron to the ski.

5. The combination of claim 2, wherein said holding means includes means for urging the boot toward the toe iron during downhill skiing and means for releasing the heel under an overload for movement relative to the ski.

6. The combination of claim 2, wherein said engaging means further comprises means for engaging the toe from above during downhill skiing.

7. The combination of claim 2, wherein said engaging means further comprises a pivotable yoke which bears against the upper side of the toe during downhill skiing.

8. The combination of claim 2, wherein one of said bearing elements comprises a pin and the other of said bearing elements has a socket for said pin.

9. The combination of claim 2, wherein one of said elements has a bushing and the other of said elements has a plug-in pivot which is removably received in said bushing during touring and cross country skiing.

10. The combination of a ski boot having a sole with a toe portion and a heel portion and a ski binding for touring as well as cross country skiing, said binding comprising a toe iron mounted directly on the ski and having first means for engaging a first part of the toe portion of the sole so that the boot can pivot with reference to the toe iron about an axis extending substantially transversely of the ski during touring and cross country skiing, and second means for engaging a second part of the toe portion of the sole during downhill skiing, said binding further comprising heel holding means for releasably coupling the heel portion of the sole to the ski only when said second means is engaging said second part of the toe portion during downhill skiing, said heel holding means being affixed directly to the ski.

11. The combination of claim 10, wherein said first means has two split bearings and the toe portion has two pivot pins which are received in said split bearings during touring or cross country skiing, said toe iron further comprising means for closing said bearings so as to confine the pivot pins therein during touring and cross country skiing.

12. The combination of claim 10, wherein said toe iron comprises a base, a sole holder and a pivot defining said axis and pivotably coupling said sole holder to said base.

13. The combination of a ski boot having a sole with a toe portion and a heel portion and a ski binding for touring as well as cross country skiing, said binding comprising a toe iron mounted on the ski and rotatable relative thereto through substantially 180 degrees between first and second positions, said toe iron having first means for engaging the toe portion of the sole so that the boot can pivot with reference to the toe iron about an axis extending substantially transversely of the ski during touring and cross country skiing in the first position of the toe iron, and second means for engaging the toe portion of the sole during downhill skiing in the second position of the toe iron, said binding further comprising heel holding means for releasably coupling the heel portion of the sole to the ski only when said second means is engaging said toe portion during downhill skiing, said heel holding means being affixed directly to the ski.

14. The combination of claim 13, wherein said first means comprises jaws and the toe portion has openings for said jaws.

15. The combination of claim 14, wherein said toe iron further comprises means for releasably locking said jaws in said openings.

16. The combination of claim 13, wherein said toe iron is rotatable relative to the ski about a second axis which extends at right angles to said transversely extending axis.

17. The combination of claim 16, wherein said first and second means are disposed diametrically opposite each other with reference to said second axis.

18. The combination of claim 13, further comprising means for releasably locking said toe iron in each of said positions.

19. The combination of claim 18, wherein said locking means comprises an adjustable overload safety device.

* * * * *